US007658663B2

(12) United States Patent
Aisenbrey

(10) Patent No.: US 7,658,663 B2
(45) **Date of Patent: *Feb. 9, 2010**

(54) LOW COST ELECTRONIC TOYS AND TOY COMPONENTS MANUFACTURED FROM CONDUCTIVE LOADED RESIN-BASED MATERIALS

(75) Inventor: Thomas Aisenbrey, Littleton, CO (US)

(73) Assignee: Integral Technologies, Inc., Bellingham, WA (US)

( * ) Notice: Subject to any disclaimer, the term of this patent is extended or adjusted under 35 U.S.C. 154(b) by 754 days.

This patent is subject to a terminal disclaimer.

(21) Appl. No.: 11/225,362

(22) Filed: Sep. 13, 2005

(65) Prior Publication Data

US 2006/0003667 A1 Jan. 5, 2006

Related U.S. Application Data

(63) Continuation-in-part of application No. 10/877,092, filed on Jun. 25, 2004, now abandoned, which is a continuation of application No. 10/309,429, filed on Dec. 4, 2002, now Pat. No. 6,870,516, which is a continuation-in-part of application No. 10/075,778, filed on Feb. 14, 2002, now Pat. No. 6,741,221.

(60) Provisional application No. 60/610,485, filed on Sep. 16, 2004, provisional application No. 60/317,808, filed on Sep. 7, 2001, provisional application No. 60/269,414, filed on Feb. 16, 2001, provisional application No. 60/268,822, filed on Feb. 15, 2001.

(51) Int. Cl.

| | |
|---|---|
| ***A63F 9/24*** | (2006.01) |
| ***A63F 13/00*** | (2006.01) |
| ***G06F 17/00*** | (2006.01) |
| ***G06F 19/00*** | (2006.01) |

(52) U.S. Cl. ..... 446/454; 43/26.1; 156/441; 273/363; 343/715; 343/912; 446/175; 446/289; 446/368; 446/470

(58) Field of Classification Search ..... 446/454
See application file for complete search history.

(56) References Cited

U.S. PATENT DOCUMENTS 4,100,013 A * 7/1978 Medler et al. ..... 156/441

(Continued)

FOREIGN PATENT DOCUMENTS

GB 377449 A 1/2003

*Primary Examiner*—John M. Hotaling, II
*Assistant Examiner*—Paul A. D'Agostino
(74) *Attorney, Agent, or Firm*—Douglas R. Schnabel

(57) ABSTRACT

Toys and toy components are formed of a conductive loaded resin-based material. The conductive loaded resin-based material comprises micron conductive powder(s), conductive fiber(s), or a combination of conductive powder and conductive fibers in a base resin host. The percentage by weight of the conductive powder(s), conductive fiber(s), or a combination thereof is between about 20% and 50% of the weight of the conductive loaded resin-based material. The micron conductive powders are metals or conductive non-metals or metal plated non-metals. The micron conductive fibers may be metal fiber or metal plated fiber. Further, the metal plated fiber may be formed by plating metal onto a metal fiber or by plating metal onto a non-metal fiber. Any platable fiber may be used as the core for a non-metal fiber. Superconductor metals may also be used as micron conductive fibers and/or as metal plating onto fibers in the present invention.

7 Claims, 10 Drawing Sheets

U.S. PATENT DOCUMENTS

| | | | | |
|---|---|---|---|---|
| 4,134,120 | A * | 1/1979 | DeLoach et al. | 343/715 |
| 4,166,338 | A * | 9/1979 | Asano | 446/456 |
| 4,406,085 | A * | 9/1983 | Rhodes | 446/456 |
| 4,443,014 | A * | 4/1984 | Kovit et al. | 273/363 |
| 4,717,366 | A * | 1/1988 | Ishimoto | 446/470 |
| 5,309,664 | A * | 5/1994 | Wright | 43/26.1 |
| 5,334,076 | A * | 8/1994 | Shinozuka | 446/456 |
| 5,771,027 | A * | 6/1998 | Marks et al. | 343/912 |
| 5,816,887 | A | 10/1998 | Rudell et al. | 446/456 |
| 6,565,410 | B1 * | 5/2003 | Allen | 446/454 |
| 6,773,231 | B2 | 8/2004 | Urquiaga | 446/45.4 |
| 2001/0041495 | A1 | 11/2001 | Chan | |
| 2001/0041497 | A1 * | 11/2001 | Hornsby et al. | 446/368 |
| 2002/0049021 | A1 * | 4/2002 | Hornsby et al. | 446/289 |
| 2002/0081941 | A1 | 6/2002 | Allmon et al. | 446/460 |
| 2002/0123297 | A1 * | 9/2002 | Hornsby et al. | 446/484 |
| 2002/0177383 | A1 * | 11/2002 | Hornsby et al. | 446/175 |
| 2003/0040247 | A1 | 2/2003 | Rehkemper et al. | 446/34 |
| 2003/0232649 | A1 | 12/2003 | Gizis et al. | 463/40 |
| 2004/0061479 | A1 | 4/2004 | Harrelson et al. | 320/125 |
| 2004/0082268 | A1 * | 4/2004 | Choi | 446/454 |
| 2004/0107864 | A1 | 6/2004 | Hayden | 104/288 |
| 2004/0116044 | A1 | 6/2004 | Foster et al. | 446/435 |
| 2004/0121700 | A1 * | 6/2004 | Derrah | 446/154 |

* cited by examiner

LOW COST ELECTRONIC TOYS AND TOY COMPONENTS MANUFACTURED FROM CONDUCTIVE LOADED RESIN-BASED MATERIALS

RELATED PATENT APPLICATIONS

This Patent Application claims priority to the U.S. Provisional Patent Application 60/610,485 filed on Sep. 16, 2004, which is herein incorporated by reference in its entirety.

This Patent Application is a Continuation-in-Part filed as U.S. patent application Ser. No. 10/877,092, filed on Jun. 25, 2004, now abandoned which is a Continuation filed as U.S. patent application Ser. No. 10/309,429, filed on Dec. 4, 2002, now issued as U.S. Pat. No. 6,870,516, also incorporated by reference in its entirety, filed as U.S. patent application Ser. No. 10/075,778, filed on Feb. 14, 2002, now issued as U.S. Pat. No. 6,741,221, which claimed priority to U.S. Provisional Patent Application Ser. No. 60/317,808, filed on Sep. 7, 2001, Ser. No. 60/269,414, filed on Feb. 16, 2001, and Ser. No. 60/268,822, filed on Feb. 15, 2001, all of which are incorporated by reference in their entirety.

BACKGROUND OF THE INVENTION (1) Field of the Invention

This invention relates to electronic toys and toy components and, more particularly, to electronic toys and toy components molded of conductive loaded resin-based materials comprising micron conductive powders, micron conductive fibers, or a combination thereof, substantially homogenized within a base resin when molded. This manufacturing process yields a conductive part or material usable within the EMF, thermal, acoustic, or electronic spectrum(s).

(2) Description of the Prior Art

Radio-controlled (RC) toys become popular in recent years. A RC toy performs various functions in response to signals from a remote controlling device. These control signals are transmitted and received via antennas integrated in the remote controller and in the toy. Typically, the antennas are formed from a metal wire or rod. While this approach can work adequately, metal rods or wires present packaging difficulties, break easily, and can present a hazard for small children. An object of the present invention is to improve the performance, reliability, and design flexibility of RC controllers and toys. In some cases, the power supply for a small motor in the RC toy is a battery. In other cases, as for example with slot cars or electric trains, an AC/DC converter provides DC power to the race track or train track. Metal rails or metal strips are placed on the tracks and metal brushes or flairs are used to conduct current into the car or train. Another object of the present invention is to improve the performance and design flexibility of electric slot cars, trains, and tracks.

Several prior art inventions relate to electronic toys and, in particular, radio-controlled toys. U.S. Patent Publication US 2004/0061479 A1 to Harrelson et al teaches a transmitter for a radio-controlled toy which also acts as a charging station and has readouts so the user is able to know the status of the battery charge. This invention also teaches the ability of the user to alter the look of the vehicle by having interchangeable components. U.S. patent U.S. Pat. No. 6,773,321 B1 to Urquiaga teaches a remote control convertible toy vehicle assembly that incorporates a generator capable of recharging the battery during use to help prolong the life of said battery. U.S. Pat. No. 5,816,887 to Rudell et al teaches a radio controlled toy with a remote accessory activation that utilizes a trigger mechanism on the radio controlled toy able to interact with a trigger mechanism on the remote accessory and achieve the desired result or action.

U.S. Patent Publication US 2004/0116044 A1 to Foster et al teaches a remote controlled vehicle able to launch a remote controlled flying vehicle. This invention teaches after the launch of the flying vehicle the power is shut off to the original remote controlled vehicle allowing the same transmitter to operate both vehicles. U.S. Patent Publication US 2003/0232649 A1 to Gizis et al teaches a gaming system and method that utilizes a remote controlled vehicle that caries a video camera and sends the visual information back to a display screen on the radio transmitter. This invention also teaches of the ability to transfer data back and forth to other transmitters by having a receiving unit built into its design. U.S. Patent Publication US 2002/0081941 A1 to Allmon et al teaches a remote controlled model vehicle with an audio output system such as a cassette tape player or CD player or Am/Fm receiver built into the vehicle.

U.S. Patent Publication US 2001/0041495 A1 to Chan teaches an interactive doll and activity center that has series of infrared sensors in both the doll and the activity center and an artificial speech unit in the doll that communicates messages to the user. U.S. Patent Publication US 204/0107864 A1 to Hayden teaches an independent adjustable regulated direct current power supply and adjustable rheostat controller for each lane on the track in a hobby slot car system. U.S. Patent Publication US 2003/0040247 A1 to Rehkemper et al teaches of a remote controlled toy airplane assembly that has a microprocessor for assisting flight operations. The invention also teaches that all of the flight processes are handled by the microprocessor rather than the typical servo configuration currently known in the art.

SUMMARY OF THE INVENTION

A principal object of the present invention is to provide an effective toy or toy component.

A further object of the present invention is to provide a method to form a toy or toy component.

A further object of the present invention is to provide an antenna for a radio-controlled toy.

A further object of the present invention is to provide an antenna that is molded into the body of a radio-controlled toy.

A further object of the present invention is to provide an antenna for a controller of a radio-controlled toy.

A further object of the present invention is to provide an antenna that is molded into the body of a controller of a radio-controlled toy.

A further object of the present invention is to provide molded contact points for an electric slot car or train.

A further object of the present invention is to provide a slot car or electric train track.

A yet further object of the present invention is to provide a toy or toy component molded of conductive loaded resin-based material where the electrical characteristics can be altered or the visual characteristics can be altered by forming a metal layer over the conductive loaded resin-based material.

A yet further object of the present invention is to provide methods to fabricate a toy or toy component from a conductive loaded resin-based material incorporating various forms of the material.

A yet further object of the present invention is to provide a method to fabricate a toy or toy component from a conductive loaded resin-based material where the material is in the form of a fabric.

In accordance with the objects of this invention, a radio controlled toy device is achieved. The device comprises a radio receiver. An antenna is connected to the radio receiver. The antenna comprises a conductive loaded, resin-based material comprising micron conductive fiber in a base resin host. A toy body holds the radio receiver and the antenna.

Also in accordance with the objects of this invention, a motorized toy device is achieved. The device comprises a toy body. An electric motor is in the toy body. A conductive contact is on the toy body to connect the electric motor to a conductive runner on a simulated track. The conductive contact comprises a conductive loaded, resin-based material comprising micron conductive fiber in a base resin host. The percent by weight of the micron conductive fiber is between 20% and 50% of the total weight.

Also in accordance with the objects of this invention, a method to form a remote controlled toy of a transportation vehicle device is achieved. The method comprises providing a toy body. A conductive loaded, resin-based material is provided comprising micron conductive fiber in a resin-based host. The conductive loaded, resin-based material is molded into an antenna. The antenna is into the toy body.

BRIEF DESCRIPTION OF THE DRAWINGS

In the accompanying drawings forming a material part of this description, there is shown.

DESCRIPTION OF THE PREFERRED EMBODIMENTS

Figure 1:
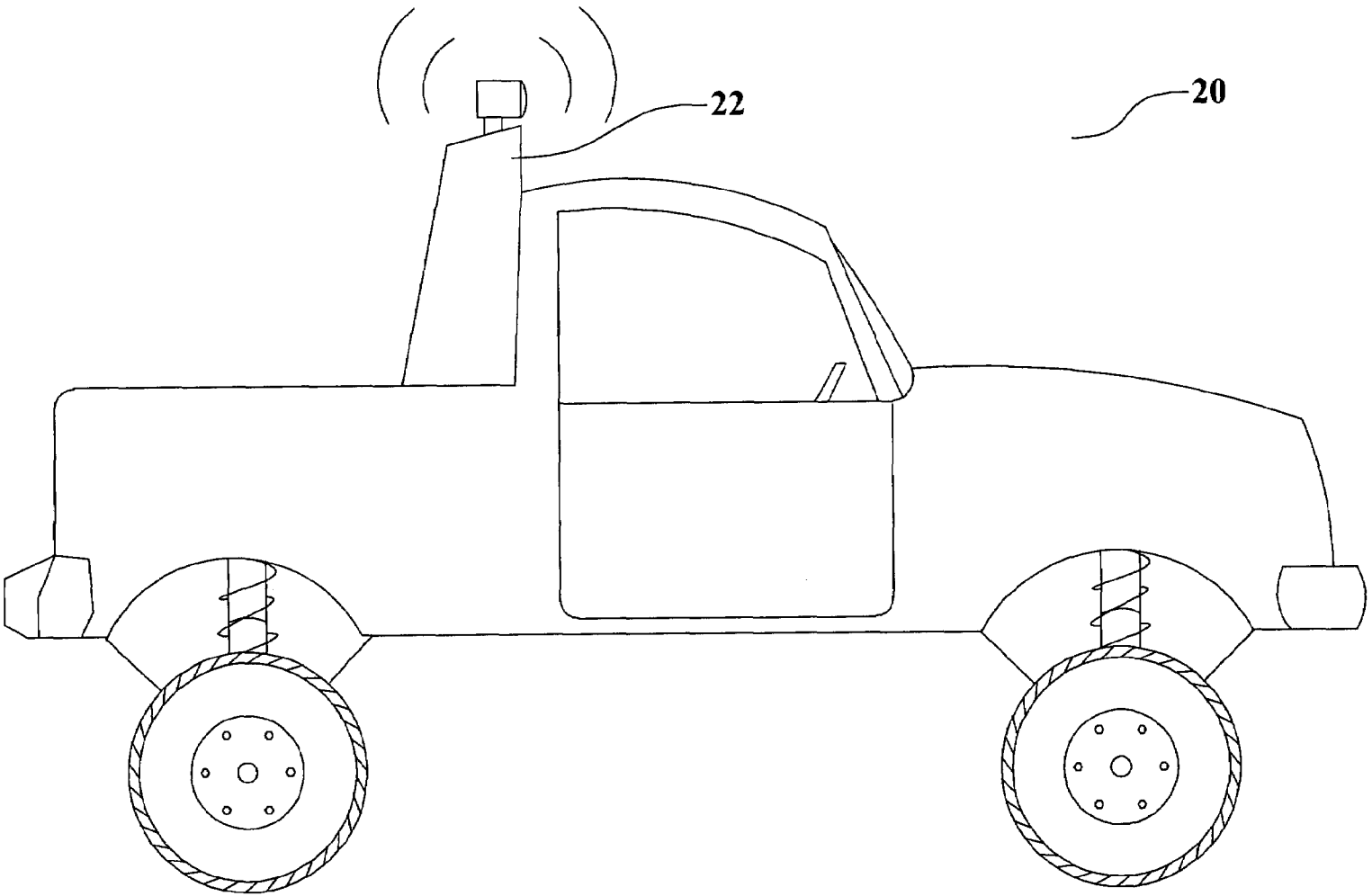
FIG. 1 illustrates a first preferred embodiment of the present invention showing a radio-controlled (RC) toy truck comprising a conductive loaded resin-based material.

This invention relates to toys and toy components molded of conductive loaded resin-based materials comprising micron conductive powders, micron conductive fibers, or a combination thereof, substantially homogenized within a base resin when molded.

The conductive loaded resin-based materials of the invention are base resins loaded with conductive materials, which then makes any base resin a conductor rather than an insulator. The resins provide the structural integrity to the molded part. The micron conductive fibers, micron conductive powders, or a combination thereof, are substantially homogenized within the resin during the molding process, providing the electrical, thermal, and/or acoustical continuity.

The conductive loaded resin-based materials can be molded, extruded or the like to provide almost any desired shape or size. The molded conductive loaded resin-based materials can also be cut, stamped, or vacuumed formed from an injection molded or extruded sheet or bar stock, over-molded, laminated, milled or the like to provide the desired shape and size. The thermal or electrical conductivity characteristics of toys and toy components fabricated using conductive loaded resin-based materials depend on the composition of the conductive loaded resin-based materials, of which the loading or doping parameters can be adjusted, to aid in achieving the desired structural, electrical or other physical characteristics of the material. The selected materials used to fabricate the toys and toy components are substantially homogenized together using molding techniques and or methods such as injection molding, over-molding, insert molding, thermo-set, protrusion, extrusion, calendaring, or the like. Characteristics related to 2D, 3D, 4D, and 5D designs, molding and electrical characteristics, include the physical and electrical advantages that can be achieved during the molding process of the actual parts and the polymer physics associated within the conductive networks within the molded part(s) or formed material(s).

In the conductive loaded resin-based material, electrons travel from point to point when under stress, following the path of least resistance. Most resin-based materials are insulators and represent a high resistance to electron passage. The doping of the conductive loading into the resin-based material alters the inherent resistance of the polymers. At a threshold concentration of conductive loading, the resistance through the combined mass is lowered enough to allow electron movement. Speed of electron movement depends on conductive loading concentration, that is, the separation between the conductive loading particles. Increasing conductive loading content reduces interparticle separation distance, and, at a critical distance known as the percolation point, resistance decreases dramatically and electrons move rapidly.

Resistivity is a material property that depends on the atomic bonding and on the microstructure of the material. The atomic microstructure material properties within the conductive loaded resin-based material are altered when molded into a structure. A substantially homogenized conductive microstructure of delocalized valance electrons is created. This microstructure provides sufficient charge carriers within the molded matrix structure. As a result, a low density, low resistivity, lightweight, durable, resin based polymer microstructure material is achieved. This material exhibits conductivity comparable to that of highly conductive metals such as silver, copper or aluminum, while maintaining the superior structural characteristics found in many plastics and rubbers or other structural resin based materials.

The use of conductive loaded resin-based materials in the fabrication of toys and toy components significantly lowers the cost of materials and the design and manufacturing processes used to hold ease of close tolerances, by forming these materials into desired shapes and sizes. The toys and toy components can be manufactured into infinite shapes and sizes using conventional forming methods such as injection molding, over-molding, or extrusion, calendaring, or the like.

The conductive loaded resin-based materials, when molded, typically but not exclusively produce a desirable usable range of resistivity from between about 5 and 25 ohms per square, but other resistivities can be achieved by varying the doping parameters and/or resin selection(s).

The conductive loaded resin-based materials comprise micron conductive powders, micron conductive fibers, or any combination thereof, which are substantially homogenized together within the base resin, during the molding process, yielding an easy to produce low cost, electrically conductive, close tolerance manufactured part or circuit. The resulting molded article comprises a three dimensional, continuous network of conductive loading and polymer matrix. Exemplary micron conductive powders include carbons, graphites, amines or the like, and/or of metal powders such as nickel, copper, silver, aluminum, nichrome, or plated or the like. The use of carbons or other forms of powders such as graphite(s) etc. can create additional low level electron exchange and, when used in combination with micron conductive fibers, creates a micron filler element within the micron conductive network of fiber(s) producing further electrical conductivity as well as acting as a lubricant for the molding equipment. Carbon nano-tubes may be added to the conductive loaded resin-based material. The addition of conductive powder to the micron conductive fiber loading may increase the surface conductivity of the molded part, particularly in areas where a skinning effect occurs during molding.

The micron conductive fibers may be metal fiber or metal plated fiber. Further, the metal plated fiber may be formed by plating metal onto a metal fiber or by plating metal onto a non-metal fiber. Exemplary metal fibers include, but are not limited to, stainless steel fiber, copper fiber, nickel fiber, silver fiber, aluminum fiber, nichrome fiber, or the like, or combinations thereof. Exemplary metal plating materials include, but are not limited to, copper, nickel, cobalt, silver, gold, palladium, platinum, ruthenium, rhodium, and nichrome, and alloys of thereof. Any platable fiber may be used as the core for a non-metal fiber. Exemplary non-metal fibers include, but are not limited to, carbon, graphite, polyester, basalt, man-made and naturally-occurring materials, and the like. In addition, superconductor metals, such as titanium, nickel, niobium, and zirconium, and alloys of titanium, nickel, niobium, and zirconium may also be used as micron conductive fibers and/or as metal plating onto fibers in the present invention.

The structural material may be any polymer resin or combination of polymer resins. Non-conductive resins or inherently conductive resins may be used as the structural material. Conjugated polymer resins, complex polymer resins, and/or inherently conductive resins may be used as the structural material. The dielectric properties of the resin-based material will have a direct effect upon the final electrical performance of the conductive loaded resin-based material. Many different dielectric properties are possible depending on the chemical makeup and/or arrangement, such as linking, cross-linking or the like, of the polymer, co-polymer, monomer, ter-polymer, or homo-polymer material. Structural material can be, here given as examples and not as an exhaustive list, polymer resins produced by GE PLASTICS, Pittsfield, Mass., a range of other plastics produced by GE PLASTICS, Pittsfield, Mass., a range of other plastics produced by other manufacturers, silicones produced by GE SILICONES, Waterford, N.Y., or other flexible resin-based rubber compounds produced by other manufacturers.

The resin-based structural material loaded with micron conductive powders, micron conductive fibers, or in combination thereof can be molded, using conventional molding methods such as injection molding or over-molding, or extrusion, or compression molding, or calendaring, to create desired shapes and sizes. The molded conductive loaded resin-based materials can also be stamped, cut or milled as desired to form create the desired shape form factor(s) of the toys and toy components. The doping composition and directionality associated with the micron conductors within the loaded base resins can affect the electrical and structural characteristics of the toys and toy components and can be precisely controlled by mold designs, gating and or protrusion design(s) and or during the molding process itself. In addition, the resin base can be selected to obtain the desired thermal characteristics such as very high melting point or specific thermal conductivity.

A resin-based sandwich laminate could also be fabricated with random or continuous webbed micron stainless steel fibers or other conductive fibers, forming a cloth like material. The webbed conductive fiber can be laminated or the like to materials such as Teflon, Polyesters, or any resin-based flexible or solid material(s), which when discretely designed in fiber content(s), orientation(s) and shape(s), will produce a very highly conductive flexible cloth-like material. Such a cloth-like material could also be used in forming toys and toy components that could be embedded in cloth as well as other resin materials such as rubber(s) or plastic(s). When using conductive fibers as a webbed conductor as part of a laminate or cloth-like material, the fibers may have diameters of between about 3 and 12 microns, typically between about 8 and 12 microns or in the range of about 10 microns, with length(s) that can be seamless or overlapping.

The conductive loaded resin-based material may also be formed into a prepreg laminate, cloth, or webbing. A laminate, cloth, or webbing of the conductive loaded resin-based material is first impregnated with a resin-based material. In various embodiments, the conductive loaded resin-based material is dipped, coated, sprayed, and/or extruded with resin-based material to cause the laminate, cloth, or webbing to adhere together in a prepreg grouping that is easy to handle. This prepreg is placed, or laid up, onto a form and is then heated to form a permanent bond. In another embodiment, the prepreg is laid up onto the impregnating resin while the resin is still wet and is then cured by heating or other means. In another embodiment, the wet lay-up is performed by laminating the conductive loaded resin-based prepreg over a honeycomb structure. In yet another embodiment, a wet prepreg is formed by spraying, dipping, or coating the conductive loaded resin-based material laminate, cloth, or webbing in high temperature capable paint.

Carbon fiber and resin-based composites are found to display unpredictable points of failure. In carbon fiber systems there is no elongation of the structure. By comparison, in the present invention, the conductive loaded resin-based material displays greater strength in the direction of elongation. As a result a structure formed of the conductive loaded resin-based material of the present invention will hold together even if crushed while a comparable carbon fiber composite will break into pieces.

The conductive loaded resin-based material of the present invention can be made resistant to corrosion and/or metal electrolysis by selecting micron conductive fiber and/or micron conductive powder and base resin that are resistant to corrosion and/or metal electrolysis. For example, if a corrosion/electrolysis resistant base resin is combined with stainless steel fiber and carbon fiber/powder, then a corrosion and/or metal electrolysis resistant conductive loaded resin-based material is achieved. Another additional and important feature of the present invention is that the conductive loaded resin-based material of the present invention may be made flame retardant. Selection of a flame-retardant (FR) base resin material allows the resulting product to exhibit flame retardant capability. This is especially important in toys and toy components as described herein.

The substantially homogeneous mixing of micron conductive fiber and/or micron conductive powder and base resin described in the present invention may also be described as doping. That is, the substantially homogeneous mixing converts the typically non-conductive base resin material into a conductive material. This process is analogous to the doping process whereby a semiconductor material, such as silicon, can be converted into a conductive material through the introduction of donor/acceptor ions as is well known in the art of semiconductor devices. Therefore, the present invention uses the term doping to mean converting a typically non-conductive base resin material into a conductive material through the substantially homogeneous mixing of micron conductive fiber and/or micron conductive powder into a base resin.

As an additional and important feature of the present invention, the molded conductor loaded resin-based material exhibits excellent thermal dissipation characteristics. Therefore, toys and toy components manufactured from the molded conductor loaded resin-based material can provide added thermal dissipation capabilities to the application. For example, heat can be dissipated from electrical devices physically and/or electrically connected to toys and toy components of the present invention.

As a significant advantage of the present invention, toys and toy components constructed of the conductive loaded resin-based material can be easily interfaced to an electrical circuit or grounded. In one embodiment, a wire can be attached to a conductive loaded resin-based molding via a screw that is fastened to the molding. For example, a simple sheet-metal type, self tapping screw, when fastened to the material, can achieve excellent electrical connectivity via the conductive matrix of the conductive loaded resin-based material. To facilitate this approach a boss may be molded into the conductive loaded resin-based material to accommodate such a screw. Alternatively, if a solderable screw material, such as copper, is used, then a wire can be soldered to the screw that is embedded into the conductive loaded resin-based material. In another embodiment, the conductive loaded resin-based material is partly or completely plated with a metal layer. The metal layer forms excellent electrical conductivity with the conductive matrix. A connection of this metal layer to another circuit or to ground is then made. For example, if the metal layer is solderable, then a soldered connection may be made between the molding and a grounding wire.

Where a metal layer is formed over the surface of the conductive loaded resin-based material, any of several techniques may be used to form this metal layer. This metal layer may be used for visual enhancement of the molded conductive loaded resin-based material article or to otherwise alter performance properties. Well-known techniques, such as electroless metal plating, electro metal plating, sputtering, metal vapor deposition, metallic painting, or the like, may be applied to the formation of this metal layer. If metal plating is used, then the resin-based structural material of the conductive loaded, resin-based material is one that can be metal plated. There are many of the polymer resins that can be plated with metal layers. For example, GE Plastics, SUPEC, VALOX, ULTEM, CYCOLAC, UGIKRAL, STYRON, CYCOLOY are a few resin-based materials that can be metal plated. Electroless plating is typically a multiple-stage chemical process where, for example, a thin copper layer is first deposited to form a conductive layer. This conductive layer is then used as an electrode for the subsequent plating of a thicker metal layer.

A typical metal deposition process for forming a metal layer onto the conductive loaded resin-based material is vacuum metallization. Vacuum metallization is the process where a metal layer, such as aluminum, is deposited on the conductive loaded resin-based material inside a vacuum chamber. In a metallic painting process, metal particles, such as silver, copper, or nickel, or the like, are dispersed in an acrylic, vinyl, epoxy, or urethane binder. Most resin-based materials accept and hold paint well, and automatic spraying systems apply coating with consistency. In addition, the excellent conductivity of the conductive loaded resin-based material of the present invention facilitates the use of extremely efficient, electrostatic painting techniques.

The conductive loaded resin-based material can be contacted in any of several ways. In one embodiment, a pin is embedded into the conductive loaded resin-based material by insert molding, ultrasonic welding, pressing, or other means. A connection with a metal wire can easily be made to this pin and results in excellent contact to the conductive loaded resin-based material. In another embodiment, a hole is formed in to the conductive loaded resin-based material either during the molding process or by a subsequent process step such as drilling, punching, or the like. A pin is then placed into the hole and is then ultrasonically welded to form a permanent mechanical and electrical contact. In yet another embodiment, a pin or a wire is soldered to the conductive loaded resin-based material. In this case, a hole is formed in the conductive loaded resin-based material either during the molding operation or by drilling, stamping, punching, or the like. A solderable layer is then formed in the hole. The solderable layer is preferably formed by metal plating. A conductor is placed into the hole and then mechanically and electrically bonded by point, wave, or reflow soldering.

Another method to provide connectivity to the conductive loaded resin-based material is through the application of a solderable ink film to the surface. One exemplary solderable ink is a combination of copper and solder particles in an epoxy resin binder. The resulting mixture is an active, screen-printable and dispensable material. During curing, the solder reflows to coat and to connect the copper particles and to thereby form a cured surface that is directly solderable without the need for additional plating or other processing steps. Any solderable material may then be mechanically and/or electrically attached, via soldering, to the conductive loaded resin-based material at the location of the applied solderable ink. Many other types of solderable inks can be used to provide this solderable surface onto the conductive loaded resin-based material of the present invention. Another exemplary embodiment of a solderable ink is a mixture of one or more metal powder systems with a reactive organic medium. This type of ink material is converted to solderable pure metal during a low temperature cure without any organic binders or alloying elements.

A ferromagnetic conductive loaded resin-based material may be formed of the present invention to create a magnetic or magnetizable form of the material. Ferromagnetic micron conductive fibers and/or ferromagnetic conductive powders are mixed with the base resin. Ferrite materials and/or rare earth magnetic materials are added as a conductive loading to the base resin. With the substantially homogeneous mixing of the ferromagnetic micron conductive fibers and/or micron conductive powders, the ferromagnetic conductive loaded resin-based material is able to produce an excellent low cost, low weight magnetize-able item. The magnets and magnetic devices of the present invention can be magnetized during or after the molding process. The magnetic strength of the magnets and magnetic devices can be varied by adjusting the amount of ferromagnetic micron conductive fibers and/or ferromagnetic micron conductive powders that are incorporated with the base resin. By increasing the amount of the ferromagnetic doping, the strength of the magnet or magnetic devices is increased. The substantially homogenous mixing of the conductive fiber network allows for a substantial amount of fiber to be added to the base resin without causing the structural integrity of the item to decline. The ferromagnetic conductive loaded resin-based magnets display the excellent physical properties of the base resin, including flexibility, moldability, strength, and resistance to environmental corrosion, along with excellent magnetic ability. In addition, the unique ferromagnetic conductive loaded resin-based material facilitates formation of items that exhibit excellent thermal and electrical conductivity as well as magnetism.

A high aspect ratio magnet is easily achieved through the use of ferromagnetic conductive micron fiber or through the combination of ferromagnetic micron powder with conductive micron fiber. The use of micron conductive fiber allows for molding articles with a high aspect ratio of conductive fiber to cross sectional area. If a ferromagnetic micron fiber is used, then this high aspect ratio translates into a high quality magnetic article. Alternatively, if a ferromagnetic micron powder is combined with micron conductive fiber, then the magnetic effect of the powder is effectively spread throughout the molded article via the network of conductive fiber such that an effective high aspect ratio molded magnetic article is achieved. The ferromagnetic conductive loaded resin-based material may be magnetized, after molding, by exposing the molded article to a strong magnetic field. Alternatively, a strong magnetic field may be used to magnetize the ferromagnetic conductive loaded resin-based material during the molding process.

The ferromagnetic conductive loading is in the form of fiber, powder, or a combination of fiber and powder. The micron conductive powder may be metal fiber or metal plated fiber. If metal plated fiber is used, then the core fiber is a platable material and may be metal or non-metal. Exemplary ferromagnetic conductive fiber materials include ferrite, or ceramic, materials as nickel zinc, manganese zinc, and combinations of iron, boron, and strontium, and the like. In addition, rare earth elements, such as neodymium and samarium, typified by neodymium-iron-boron, samarium-cobalt, and the like, are useful ferromagnetic conductive fiber materials. Exemplary ferromagnetic micron powder leached onto the conductive fibers include ferrite, or ceramic, materials as nickel zinc, manganese zinc, and combinations of iron, boron, and strontium, and the like. In addition, rare earth elements, such as neodymium and samarium, typified by neodymium-iron-boron, samarium-cobalt, and the like, are useful ferromagnetic conductive powder materials. A ferromagnetic conductive loading may be combined with a non-ferromagnetic conductive loading to form a conductive loaded resin-based material that combines excellent conductive qualities with magnetic capabilities.

Referring now to FIG. 1, a first preferred embodiment of the present invention is illustrated. A RC toy truck 20 is shown. In one embodiment, the RC toy truck 20 has an antenna 22 that is integrated into the roll bar of the truck 20. The antenna 22 comprises the conductive loaded resin-based material of the present invention. In this case, the conductive loaded resin-based material is molded into the roll bar 22. As additional embodiments, the antenna is formed by injection molding, extrusion, or the like. Other parts of the RC toys preferably comprise resin-based materials. More preferably, the antenna is insert-molded, from the conductive loaded resin-based material, into, or over-molded onto, the integrated roll bar 22 of the truck 20. Alternatively, the antenna devices and the integrated parts are molded separately and then joined together.

By integrating the antennas into the toy structure, the traditional whip or telescopic antenna that is typically used for a radio-controlled device is eliminated from the design. These types of antennas tend to break easily and can therefore present a safety risk for young children. The antenna of the present invention is integrated into the toy such that it is protected from easy breakage and is more visually attractive. An additional benefit of toy components comprising conductive loaded resin-based materials of the present invention is the ability to paint the components with an electrostatic paint sprayer. Esthetic qualities may thus be added to the conductive loaded resin-based material by an efficient painting process.

Figure 7:
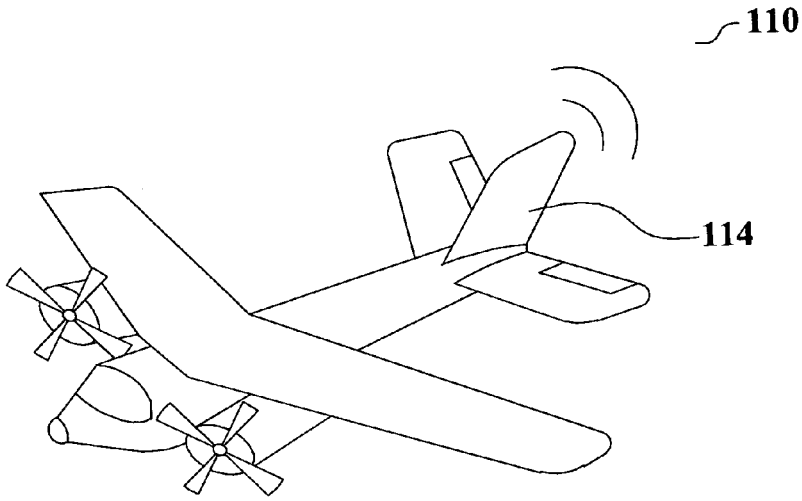
FIG. 7 illustrates a fifth preferred embodiment of the present invention showing a RC toy airplane comprising conductive loaded resin-based material.
Figure 8:
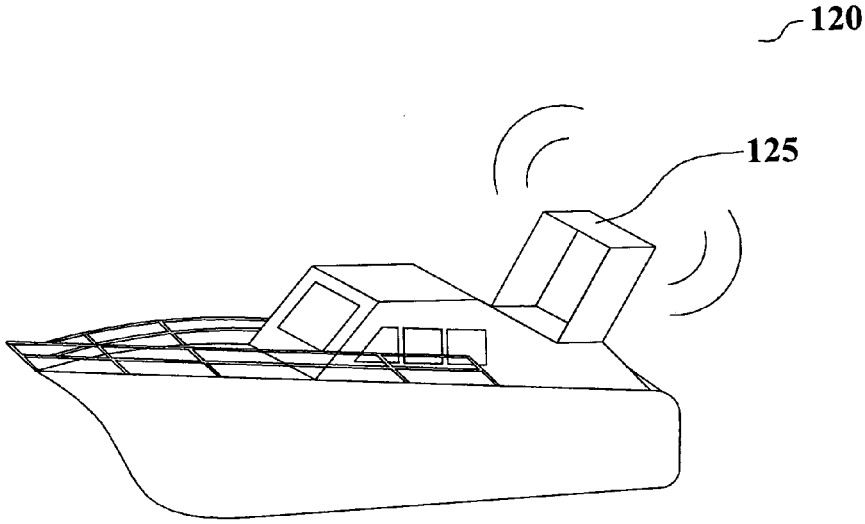
FIG. 8 illustrates a sixth preferred embodiment of the present invention showing a RC toy boat comprising conductive loaded resin-based material.

Referring now to FIG. 7, a fifth preferred embodiment of the present invention is illustrated. A RC toy airplane 110 is shown. In the embodiment, a receiving antenna comprising the conductive loaded resin-based material is integrated into the vertical stabilizer 114. Referring now to FIG. 8, a sixth preferred embodiment of the present invention is illustrated. A radio-controlled (RC) toy boat 120 is shown. The RC toy boat has an antenna integrated into the air foil 125. The antenna comprises the conductive loaded resin-based material of the present invention.

The conductive loaded resin-based material antennas of the present invention may be integrated into the toys in many ways. In one embodiment, the toy chassis and the conductive loaded resin-based material antenna are molded as separate pieces and then assembled. In another embodiment, a conductive loaded resin-based material antenna is over-molded onto a molded chassis or a molded chassis is over-molded onto a conductive loaded resin-based material antenna. While the antennas in the illustrated embodiments are integrated into structural features of the toys, alternatively, the antennas may be housed inside of the toy.

While the illustrated embodiments show various radio-controlled vehicles, it is understood that a variety of other RC toys may be so constructed. For example, RC robots, motorized dolls or animals, learning games, motorized construction sets, and the like may be built using the conductive loaded resin-based material antennas as herein described while remaining within the scope of the present invention. In addition, while the products are herein described as "toys", it is understood that various hobby products, such as motorized model airplanes, are likewise envisioned. Generally, any type of toy that responds to radio control is envisioned. As such, a toy would have a radio receiver circuit, an antenna, and a motor or other means to move or to respond.

A large number of antenna types, including but not limited to, monopole designs, dipole designs, PIFA's, inverted 'F' designs, planar designs, and the like, may be used. In addition, counterpoise structures and/or ground plane structures, not shown, may easily be molded into the conductive loaded resin-based antenna structure.

Figure 9A:
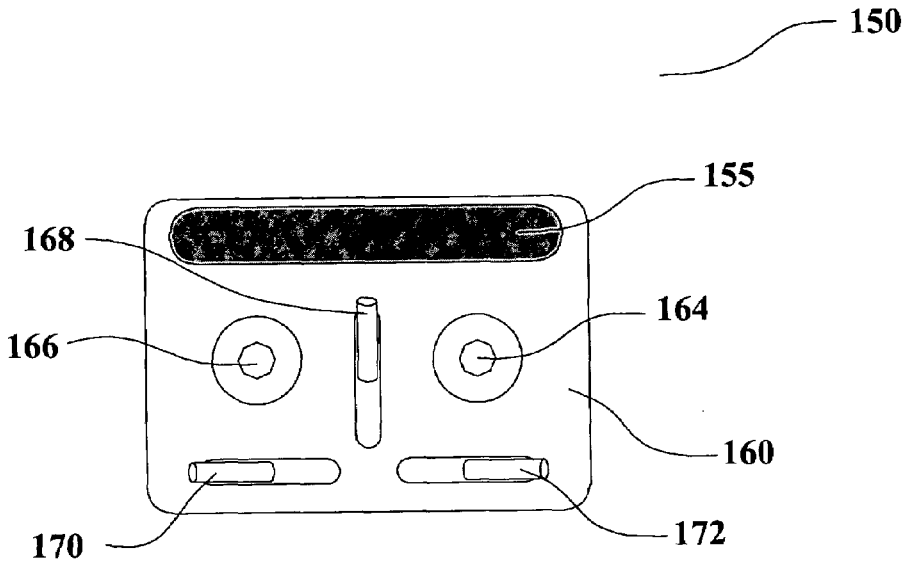
FIGS. 9*a* and 9*b* illustrate a seventh preferred embodiment of the present invention showing a controller for an RC toy comprising conductive loaded resin-based material.
Figure 9B:
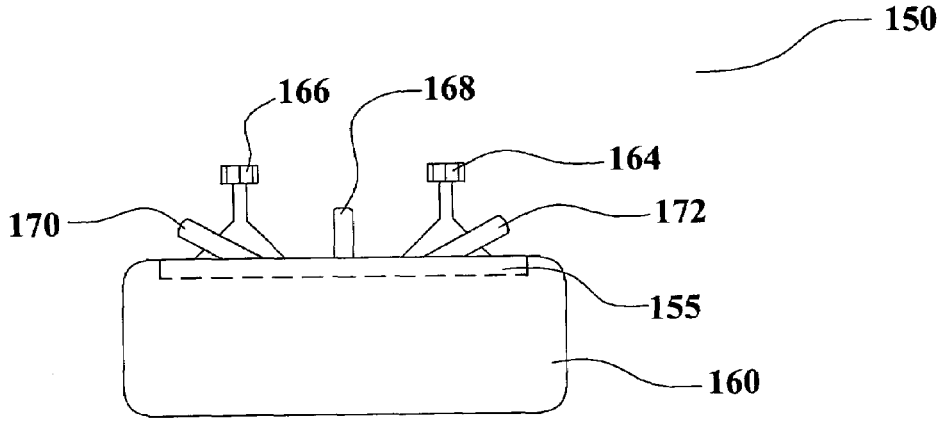

Referring now to FIGS. 9*a* and 9*b*, a seventh preferred embodiment of the present invention is illustrated. A transmitter, or controller, 150 for a radio-controlled toy is shown. The controller 150 is shown in top view in FIG. 9*a* and in side view in FIG. 9*b*. The controller 150 includes a conductive loaded resin-based antenna 155 that is integrated into the controller chassis. A plurality of operator controls 160, 164, 166, 168, 170, and 172, are included on the controller 150. In the preferred embodiment, the antenna 155 is molded into the controller chassis such that the antenna is flush with the chassis. The antenna 155 is thereby attractive and well protected.

The conductive loaded resin-based material antennas of the present invention may be integrated into the controller 150 in several ways. In one embodiment, the controller 150 and the conductive loaded resin-based material antenna are molded as separate pieces and then assembled. In another embodiment, a conductive loaded resin-based material antenna is over-molded onto a molded chassis or a molded chassis is over-molded onto a conductive loaded resin-based material antenna. While the antenna in the illustrated embodiment is integrated into the controller 150 chassis, alternatively, the antenna may be housed inside of the chassis.

Figure 10:
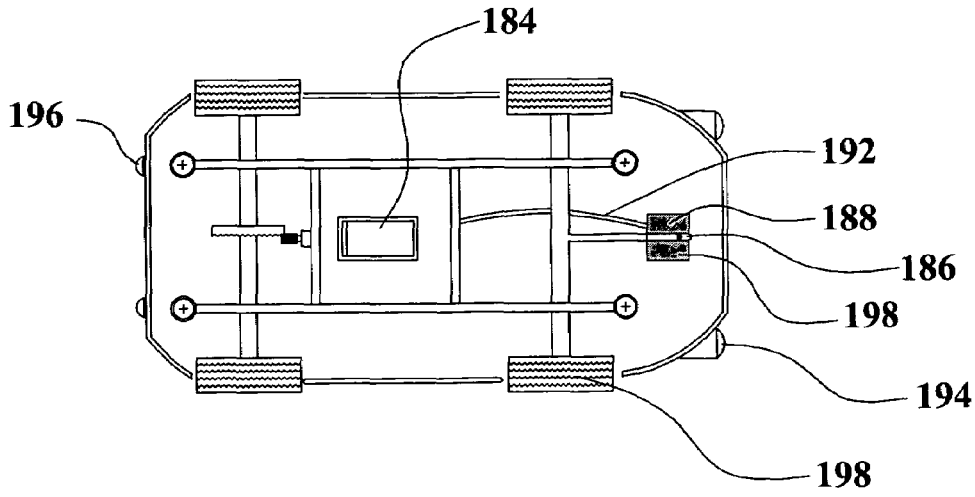
FIG. 10 illustrates an eighth preferred embodiment of the present invention showing a toy slot car comprising conductive loaded resin-based material.

Referring now to FIG. 10, an eighth preferred embodiment of the present invention is illustrated. A toy slot car is illustrated. Slot cars derive electrical power from contacts on the chassis that slide along the slot car track. A variable DC voltage is supplied to the track based on a controller that is operated by the driver. In the present invention, the toy slot car includes electrical contact brushes 188 and 198 formed of the conductive loaded resin-based material. In one embodiment, the contact brushes 188 and 198 are formed from solid but flexible pieces of conductive loaded resin-based material where the base resin is flexible at room temperature. In another embodiment, a fabric-like weave of the conductive loaded resin-based material is first manufactured and is then cut or formed into flexible contact brushes 188 and 198. The novel contact brushes 188 and 198 create a low resistance current path for power the car engine 184 while achieving better wear resistance than conventional braided wire contacts. In the preferred embodiment, the contact brushes 188 and 198 are formed beside the slot guide pin 186. In alternative embodiments of the present invention, toys and/or toy components include internal circuits comprising the conductive loaded resin-based material. These internal circuits are preferably molded into the structure of the toy and/or toy component. For example, electrical conductors 192 for powering motors, lights 196, or the like, are molded of the conductive loaded resin-based material. In another embodiment, the car tires 198 are molded of conductive loaded resin-based material.

In a related embodiment, an electric model train, not shown is formed using conductive loaded resin-based material. As in the case of the slot car, an electric train derives power and speed control from its track. In another embodiment, contact brushes or wheel contacts for an electric train are formed of the conductive loaded resin-based material. As another embodiment, the wheels of a model train are formed of the conductive loaded resin-based material of the present invention. The wheels may act as contact points with the conductive rails of the track to bring electrical power to the engine inside the model train. The wheels are formed, for example, by insert molding.

Figure 11A:
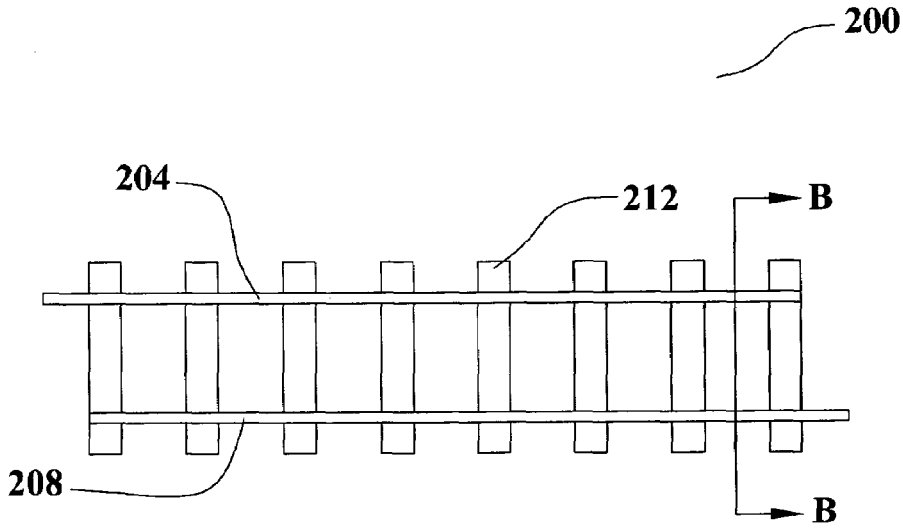
FIGS. 11*a* and 11*b* illustrate a ninth preferred embodiment of the present invention showing an electric train track comprising conductive loaded resin-based material.
Figure 11B:
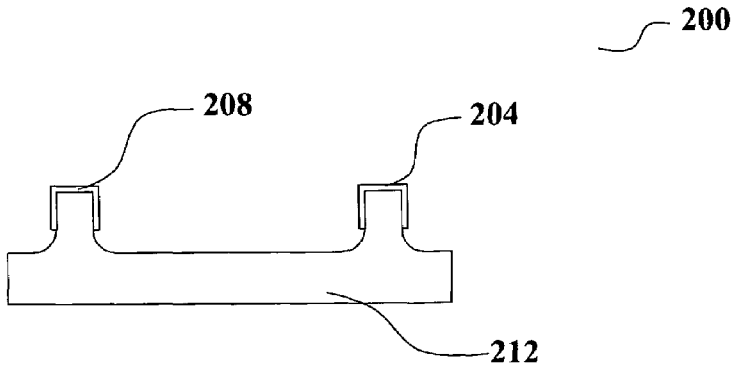

Referring now to FIGS. 11*a* and 11*b*, a ninth preferred embodiment of the present invention is illustrated. An electric train track 200 is shown in top view in FIG. 11*a* and in cross sectional view in FIG. 11*b*. The bulk 212 of the train track 200, including the simulated ties and rails, comprises a non-conductive plastic or resin based material. Conductive rails 204 comprising the conductive loaded resin-based material of the present invention are formed onto the non conductive bulk material 212. The conductive rails 204 preferably are formed by insertion molding or by over-molding. Alternatively, the conductive rails 204 are formed separately, such as by extrusion, and then physically assembled or slid into the track bulk material 212. In yet another embodiment, the conductive loaded resin-based rails 204 are plated with a metal layer, not shown, to provide a metal-like appearance. The conductive rails 200 may be molded separately and snapped onto the lattice track or may be over-molded onto the track.

Figure 12A:
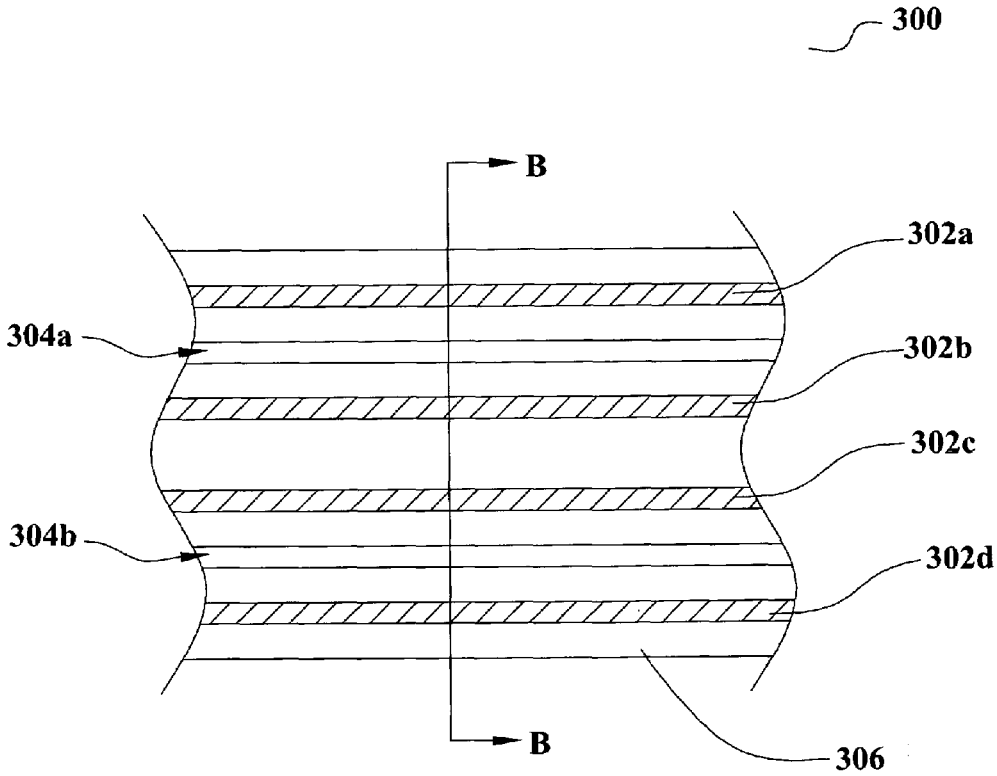
FIGS. 12*a* and 12*b* illustrate a tenth preferred embodiment of the present invention showing a slot car track comprising conductive loaded resin-based material.
Figure 12B:
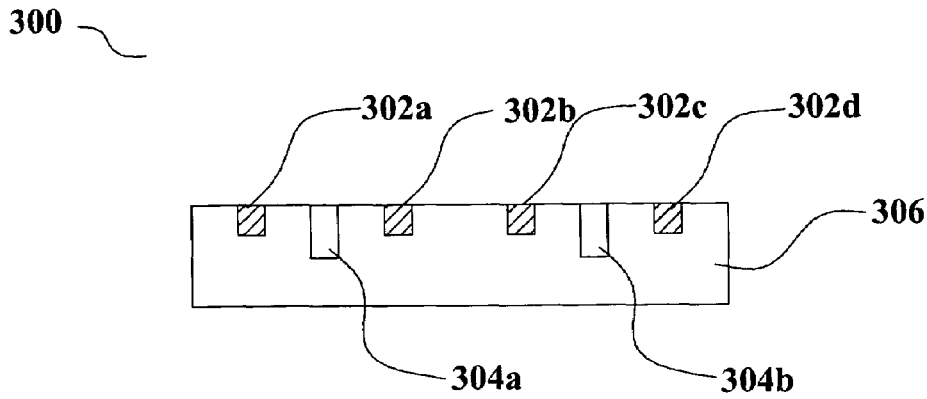

Referring now to FIGS. 12*a* and 12*b*, a tenth preferred of the present invention is illustrated. A slot car track 300 is shown in top view in FIG. 12*a* and in cross section in FIG. 12*b*. The bulk 306, or simulated roadway, of the slot car track 300 comprises a non-conductive plastic or resin based material. Slots 304*a* and 304*b* are formed and, preferably, molded into the non-conductive material for race car positioning. In this case, two slots 304*a* and 304*b* are formed. Conductive runners 302*a*, 302*b*, 302*c*, and 302*d*, comprise the conductive loaded resin-based material of the present invention formed onto the non conductive bulk material 306. The conductive runners 302*a*, 302*b*, 302*c*, and 302*d* preferably are formed by insertion molding or by co-extrusion. Alternatively, the conductive runners 302*a*, 302*b*, 302*c*, and 302*d* are formed separately, such as by extrusion, and then physically inserted into the track bulk material 306. As another embodiment, the conductive loaded resin-based runners 302*a*, 302*b*, 302*c*, and 302*d* are covered in a metal layer, not shown.

Figure 13A:
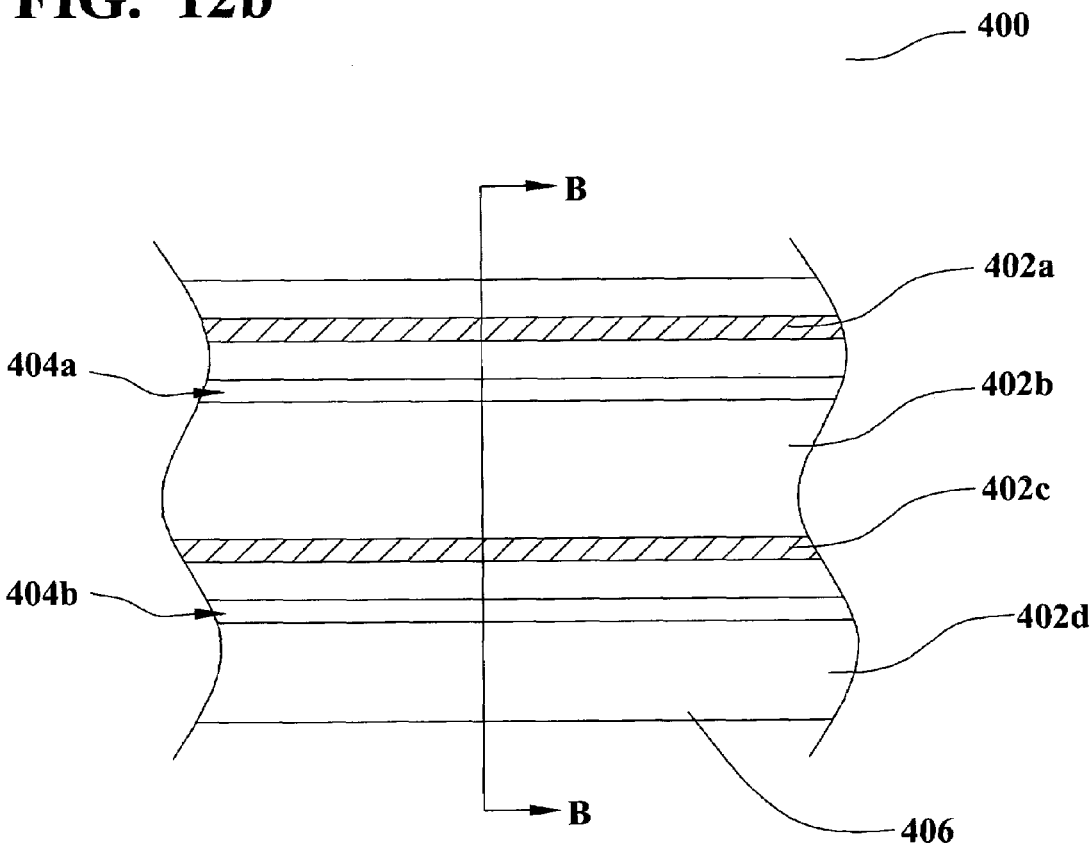
FIGS. 13*a* and 13*b* illustrate an eleventh preferred embodiment of the present invention showing a slot car track comprising conductive loaded resin-based material.
Figure 13B:
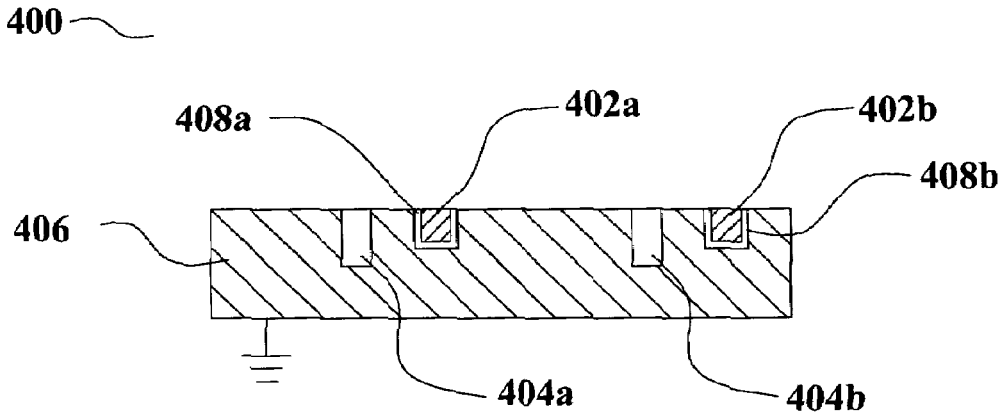

Referring now to FIGS. 13*a* and 13*b*, an eleventh preferred of the present invention is illustrated. A slot car track 400 is shown in top view in FIG. 13*a* and in cross section in FIG. 13*b*. Here, another two-lane slot car race track 400 is formed of a conductive loaded resin-based material of the present invention. In this case, both the runners 402*a* and 402*b* and the track bulk 406 are formed of the conductive loaded resin-based material using injection molding, extrusion, or the like. Slots 404*a* and 404*b* for race car positioning are molded into the conductive loaded resin-based bulk track 406. A non-conductive resin or plastic channel 408 is formed between the conductive loaded resin-based bulk track 406 and runners 404*a* and 404*b*. These non-conductive channels 408 are preferable over-molded, co-extruded, or molded separately and inserted. Finally, conductive runners 402*a* and 402*b* are formed of the conductive loaded resin-based material. The conductive runners 402*a* and 402*b* lie in the non-conductive channels such that the conductive runners 402*a* and 402*b* are electrically isolated from the bulk track 406. The conductive runners 402*a* and 402*b* are preferably insert molded, co-extruded, or molded separately and inserted. By forming the track 400 of the conductive loaded resin-based material 406 of the present invention, the need for two separate conductive rails is eliminated. The bulk track 406 is grounded to complete the circuit from runners 402*a* and 402*b*, through the car, not shown, to ground. Since the race track of this embodiment of the present invention still has two contact points, any standard slot car will be able to run on it.

Figure 2:
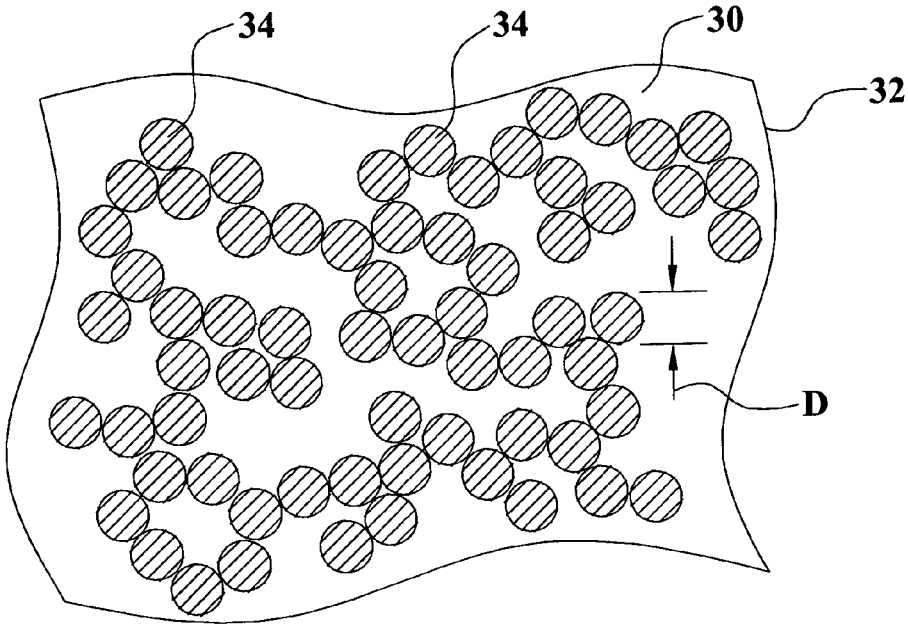
FIG. 2 illustrates a second preferred embodiment of a conductive loaded resin-based material wherein the conductive materials comprise a powder.

The conductive loaded resin-based material of the present invention typically comprises a micron powder(s) of conductor particles and/or in combination of micron fiber(s) substantially homogenized within a base resin host. FIG. 2 shows cross section view of an example of conductor loaded resin-based material 32 having powder of conductor particles 34 in a base resin host 30. In this example the diameter D of the conductor particles 34 in the powder is between about 3 and 12 microns.

Figure 3:
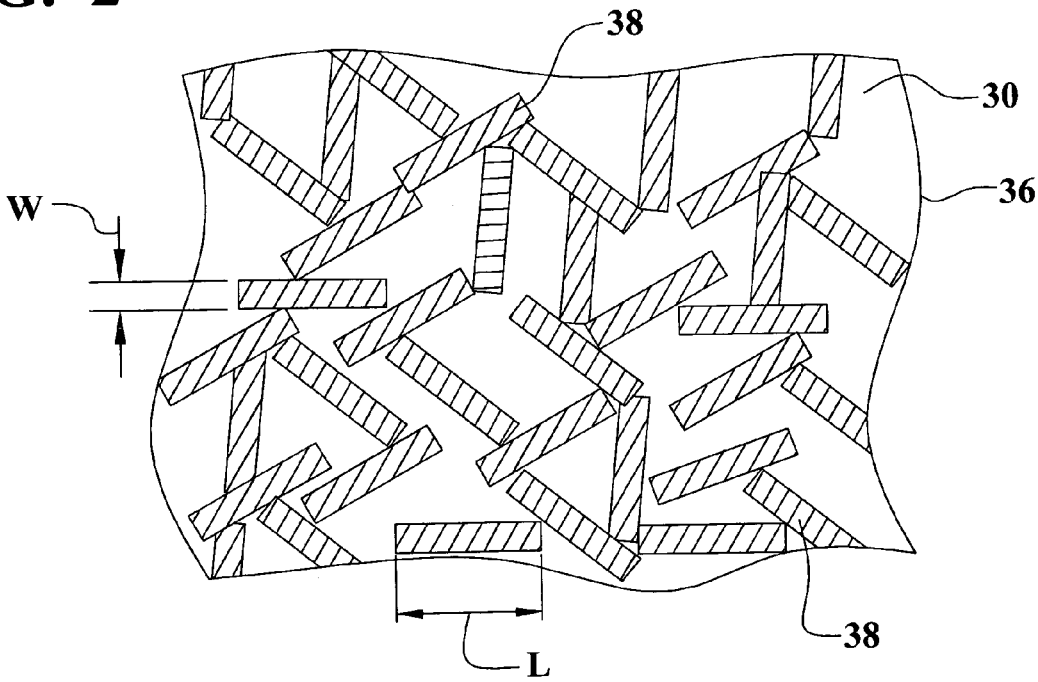
FIG. 3 illustrates a second preferred embodiment of a conductive loaded resin-based material wherein the conductive materials comprise micron conductive fibers.

FIG. 3 shows a cross section view of an example of conductor loaded resin-based material 36 having conductor fibers 38 in a base resin host 30. The conductor fibers 38 have a diameter of between about 3 and 12 microns, typically in the range of 10 microns or between about 8 and 12 microns, and a length of between about 2 and 14 millimeters. The micron conductive fibers 38 may be metal fiber or metal plated fiber. Further, the metal plated fiber may be formed by plating metal onto a metal fiber or by plating metal onto a non-metal fiber. Exemplary metal fibers include, but are not limited to, stainless steel fiber, copper fiber, nickel fiber, silver fiber, aluminum fiber, nichrome fiber, or the like, or combinations thereof. Exemplary metal plating materials include, but are not limited to, copper, nickel, cobalt, silver, gold, palladium, platinum, ruthenium, rhodium, and nichrome, and alloys of thereof. Any platable fiber may be used as the core for a non-metal fiber. Exemplary non-metal fibers include, but are not limited to, carbon, graphite, polyester, basalt, man-made and naturally-occurring materials, and the like. In addition, superconductor metals, such as titanium, nickel, niobium, and zirconium, and alloys of titanium, nickel, niobium, and zirconium may also be used as micron conductive fibers and/or as metal plating onto fibers in the present invention.

Figure 4:
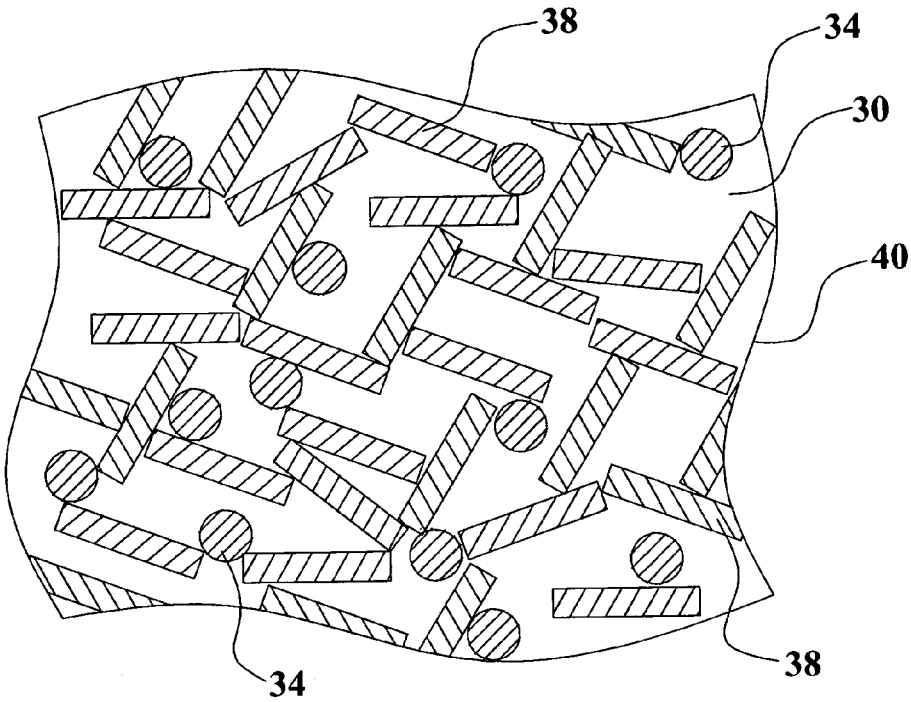
FIG. 4 illustrates a third preferred embodiment of a conductive loaded resin-based material wherein the conductive materials comprise both conductive powder and micron conductive fibers.

These conductor particles and/or fibers are substantially homogenized within a base resin. As previously mentioned, the conductive loaded resin-based materials have a sheet resistance between about 5 and 25 ohms per square, though other values can be achieved by varying the doping parameters and/or resin selection. To realize this sheet resistance the weight of the conductor material comprises between about 20% and about 50% of the total weight of the conductive loaded resin-based material. More preferably, the weight of the conductive material comprises between about 20% and about 40% of the total weight of the conductive loaded resin-based material. More preferably yet, the weight of the conductive material comprises between about 25% and about 35% of the total weight of the conductive loaded resin-based material. Still more preferably yet, the weight of the conductive material comprises about 30% of the total weight of the conductive loaded resin-based material. Stainless Steel Fiber of 6-12 micron in diameter and lengths of 4-6 mm and comprising, by weight, about 30% of the total weight of the conductive loaded resin-based material will produce a very highly conductive parameter, efficient within any EMF, thermal, acoustic, or electronic spectrum. Referring now to FIG. 4, another preferred embodiment of the present invention is illustrated where the conductive materials comprise a combination of both conductive powders 34 and micron conductive fibers 38 substantially homogenized together within the resin base 30 during a molding process.

Figure 5A:
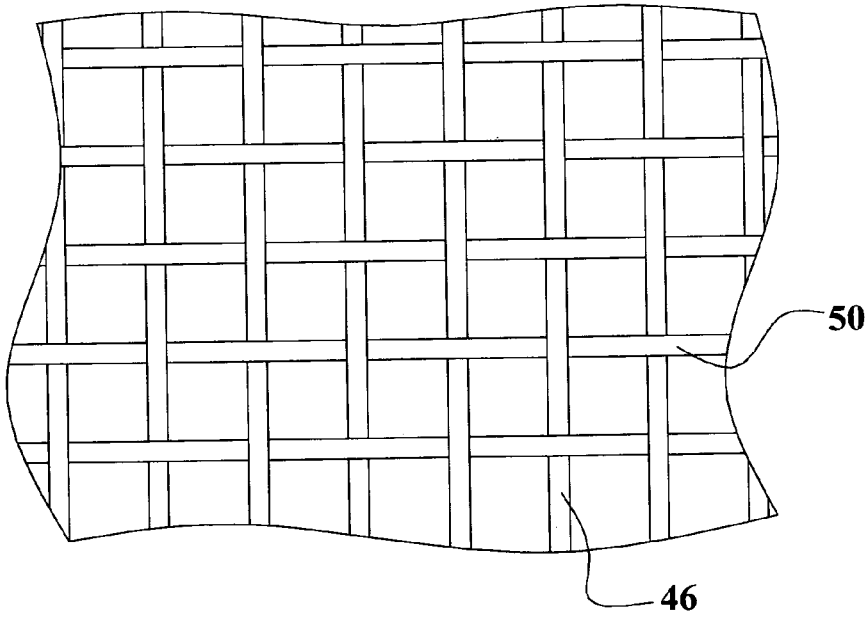
FIGS. 5*a* and 5*b* illustrate a fourth preferred embodiment wherein conductive fabric-like materials are formed from the conductive loaded resin-based material.
Figure 5B:
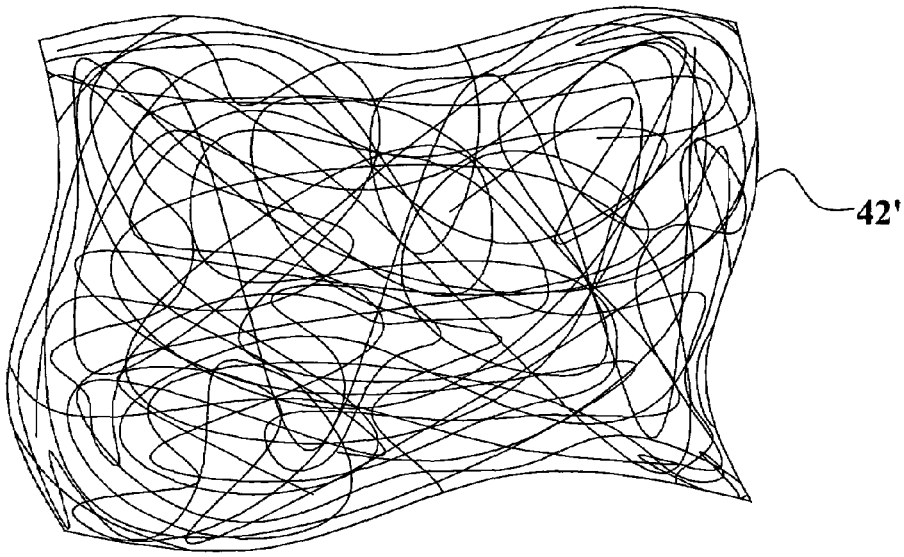

Referring now to FIGS. 5*a* and 5*b*, a preferred composition of the conductive loaded, resin-based material is illustrated. The conductive loaded resin-based material can be formed into fibers or textiles that are then woven or webbed into a conductive fabric. The conductive loaded resin-based material is formed in strands that can be woven as shown. FIG. 5*a* shows a conductive fabric 42 where the fibers are woven together in a two-dimensional weave 46 and 50 of fibers or textiles. FIG. 5*b* shows a conductive fabric 42' where the fibers are formed in a webbed arrangement. In the webbed arrangement, one or more continuous strands of the conductive fiber are nested in a random fashion. The resulting conductive fabrics or textiles 42, see FIG. 5*a*, and 42', see FIG. 5*b*, can be made very thin, thick, rigid, flexible or in solid form(s).

Similarly, a conductive, but cloth-like, material can be formed using woven or webbed micron stainless steel fibers, or other micron conductive fibers. These woven or webbed conductive cloths could also be sandwich laminated to one or more layers of materials such as Polyester(s), Teflon(s), Kevlar(s) or any other desired resin-based material(s). This conductive fabric may then be cut into desired shapes and sizes.

Figure 6A:
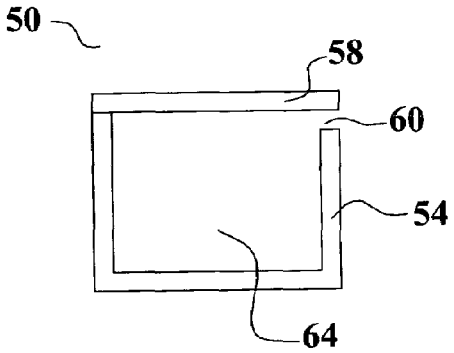
FIGS. 6*a* and 6*b* illustrate, in simplified schematic form, an injection molding apparatus and an extrusion molding apparatus that may be used to mold a toy or toy component of a conductive loaded resin-based material.

Toys and toy components formed from conductive loaded resin-based materials can be formed or molded in a number of different ways including injection molding, extrusion, calendaring, or chemically induced molding or forming. FIG. 6*a* shows a simplified schematic diagram of an injection mold showing a lower portion 54 and upper portion 58 of the mold 50. Conductive loaded blended resin-based material is injected into the mold cavity 64 through an injection opening 60 and then the substantially homogenized conductive material cures by thermal reaction. The upper portion 58 and lower portion 54 of the mold are then separated or parted and the toy or toy component is removed.

Figure 6B:
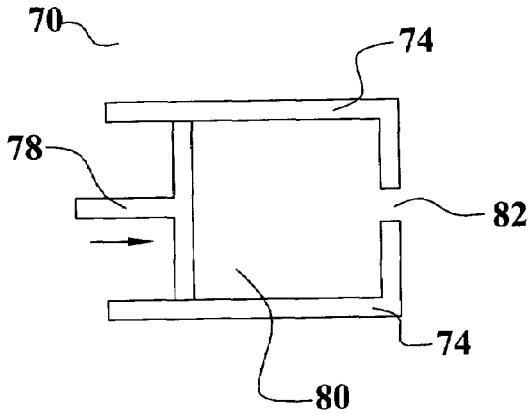

FIG. 6*b* shows a simplified schematic diagram of an extruder 70 for forming a toy or toy component using extrusion. Conductive loaded resin-based material(s) is placed in the hopper 80 of the extrusion unit 74. A piston, screw, press or other means 78 is then used to force the thermally molten or a chemically induced curing conductive loaded resin-based material through an extrusion opening 82 which shapes the thermally molten curing or chemically induced cured conductive loaded resin-based material to the desired shape. The conductive loaded resin-based material is then fully cured by chemical reaction or thermal reaction to a hardened or pliable state and is ready for use. Thermoplastic or thermosetting resin-based materials and associated processes may be used in molding the conductive loaded resin-based articles of the present invention.

The advantages of the present invention may now be summarized. An effective toy or toy component is achieved. A method to form a toy or toy component is also achieved. An antenna for a radio-controlled toy is molded into the body of a radio-controlled toy. An antenna is molded of conductive loaded, resin-based material into a controller of a radio-controlled toy. Contact points for an electric slot car or train are molded of conductive loaded, resin-based material. A slot car or electric train track is molded of conductive loaded, resin-based material. The electrical characteristics can be altered or the visual characteristics can be altered by forming a metal layer over the conductive loaded resin-based material. A method to fabricate a toy or toy component from a conductive loaded resin-based material is achieved where the material is in the form of a fabric.

As shown in the preferred embodiments, the novel methods and devices of the present invention provide an effective and manufacturable alternative to the prior art.

While the invention has been particularly shown and described with reference to the preferred embodiments thereof, it will be understood by those skilled in the art that various changes in form and details may be made without departing from the spirit and scope of the invention.

What is claimed is:

1. A radio controlled toy device comprising:

a radio receiver;

an antenna connected to said radio receiver wherein said antenna is formed of a conductive loaded, resin-based material comprising micron conductive fiber in a base resin host;

wherein the percent by weight of said micron conductive fiber is between 20% and 50% of the total weight of said conductive loaded resin-based material;

a toy body holding said radio receiver and said antenna; and wherein said antenna is molded into said toy body.

2. The device according to claim 1 further comprising micron conductive powder.

3. The device according to claim 1 wherein said micron conductive fiber is metal.

4. The device according to claim 1 wherein said micron conductive fiber comprises an inner core with an outer metal layer.

5. The device according to claim 1 wherein said toy body comprises a motorized vehicle.

6. The device according to claim 5 wherein said motorized vehicle is a car, a boat, or an airplane.

7. The device according to claim 1 further comprising a remote controller comprising an antenna comprising said conductive loaded, resin-based material.

* * * * *